US007621529B2

(12) United States Patent
Okazawa et al.

(10) Patent No.: US 7,621,529 B2
(45) Date of Patent: Nov. 24, 2009

(54) PRINTING MEDIUM FEEDING DEVICE, PRINTING APPARATUS, AND LIQUID EJECTING APPARATUS

(75) Inventors: Yoshiyuki Okazawa, Shiojiri (JP); Kohei Ueno, Shiojiri (JP); Kazuo Saito, Shiojiri (JP); Toshikazu Kotaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/947,649

(22) Filed: Nov. 29, 2007

(65) Prior Publication Data

US 2008/0128981 A1 Jun. 5, 2008

(30) Foreign Application Priority Data

| | | |
|---|---|---|
| Nov. 30, 2006 | (JP) | 2006-323009 |
| Mar. 16, 2007 | (JP) | 2007-068719 |
| Oct. 1, 2007 | (JP) | 2007-257184 |

(51) Int. Cl.
*B65H 5/06* (2006.01)

(52) U.S. Cl. ..... 271/274; 271/273; 271/272

(58) Field of Classification Search ..... 271/272, 271/273, 274

See application file for complete search history.

(56) References Cited

U.S. PATENT DOCUMENTS 5,820,122 A * 10/1998 Schneider ..... 271/188

FOREIGN PATENT DOCUMENTS

| | | |
|---|---|---|
| JP | 07-215526 | 8/1995 |
| JP | 2000-281255 | 10/2000 |
| JP | 2001-097595 | 4/2001 |
| JP | 2001-341911 | 12/2001 |
| JP | 2005-119781 | 5/2005 |
| JP | 2006-082439 | 3/2006 |
| JP | 2006-082940 | 3/2006 |
| JP | 2006082940 A * | 3/2006 |

* cited by examiner

*Primary Examiner*—Patrick H Mackey
*Assistant Examiner*—Ernesto Suarez
(74) *Attorney, Agent, or Firm*—Workman Nydegger

(57) ABSTRACT

A printing medium feeding device includes: a driving roller having a roller circumferential surface coming in contact with a printing medium to apply a feeding force to the printing medium around a core line of a rotation shaft and rotating to feeding the printing medium downstream;

a driven roller in contact with the driving roller and following the rotation thereof; a shaft supporting member supporting the rotation shaft at least at two supporting positions; and a regulation unit regulating a core position of the rotation shaft between the two supporting positions at which the rotation shaft is supported by the shaft supporting member, wherein the regulation unit has a pressing surface coming in contact with the rotation shaft from the upstream side or the downstream side of the rotation shaft, and wherein the core position of the rotation shaft at the position of the regulation unit is located by the pressing surface to be more downstream than a straight line passing through the core positions of the rotation shaft at the two supporting positions when the pressing surface comes in contact with the rotation shaft from the upstream side, and the core position of the rotation shaft at the position of the regulation unit is located to be more upstream than the straight line when the pressing surface comes in contact with the rotation shaft from the downstream side.

5 Claims, 8 Drawing Sheets

PRINTING MEDIUM FEEDING DEVICE, PRINTING APPARATUS, AND LIQUID EJECTING APPARATUS

BACKGROUND

1. Technical Field

The present invention relates to a printing medium feeding device feeding a printing medium downstream, a printing apparatus having the same to perform a printing operation on the printing medium, and a liquid ejecting apparatus.

The liquid ejecting apparatus is not limited to a printing apparatus such as a printer, a copier, or a facsimile that ejects ink from an ink jet printing head to perform the printing operation on a printing medium, but also includes an apparatus capable of ejecting a liquid corresponding to the ink from a liquid ejecting head corresponding to the ink jet printing head on the printing medium to deposit the liquid on the printing medium.

In addition to the printing head, examples of the liquid ejecting head include a color material ejecting head used to manufacture a color filter such as that used in a liquid crystal display, an electrode material (conductive paste) ejecting head used to form an electrode such as that used in an organic EL display or a field emission display (FED), a bio-organism ejecting head used to manufacture a bio chip, and a sample ejecting head as a precision pipette.

2. Related Art

A printing apparatus such as a facsimile or a printer includes a paper feeding device that feeds printing paper downstream, which is a printing medium. In addition, the paper feeding device includes a driving roller driven by rotation of a motor and a driven roller coming in elastic contact with the driving roller and following the rotation of the driving roller. When the ends of a rotation shaft of the driving roller are supported by bearings, the center portion of the rotation shaft of the driving roller may be bent downward due to load applied from the driven roller or the driving roller may be bent upward due to a reaction force (tensile force). To avoid these problems, there are known configurations in which the rotation shaft is supported between two shaft supporting portions (JP-A-2006-82439, JP-A-2001-341911, and JP-A-2000-281255).

If the rotation shaft has deviation in component precision, the deviation may cause displacement in the driving roller upstream or downstream every certain period at the rotating time, thereby deteriorating printing paper transport precision. FIGS. 6A and 6B show these problems. Reference numeral 41 denotes a discharge driving roller discharging the printing paper, reference numeral 42 denotes a discharge driven roller coming in elastic contact with the discharge driving roller 41 and following the rotation of the discharge driving roller, and reference numeral 40 denotes a rotation shaft of the discharge driving roller driven by rotation of a motor (not shown). A plurality of the discharge driving rollers 41 are arranged in a line direction of the rotation shaft 40 at an appropriate interval (for example, see FIG. 1 or the like). FIG. 6A is a diagram illustrating the rotation shaft 40 when viewed in a Y direction. FIG. 6B is a sectional view illustrating the rotation shaft taken along the line A-A shown in FIG. 6A. X, Y and Z directions denote a paper width direction, a paper feeding direction, and a direction perpendicular to the printing surface, respectively.

In FIG. 6A, H denotes a supporting position of the rotation shaft 40 and CL denotes a straight line passing through a shaft core (which is denoted by Ca) at two supporting positions H of the rotation shaft 40. As shown in FIGS. 6A and 6B, the deviation of the rotation shaft 40 is smaller at the positions close to the supporting positions H and is larger at positions near the point equidistant between the two supporting positions.

As shown in FIG. 6B, core positions of the rotation shaft 40 at the supporting positions H (denoted by 40A) are each denoted by Ca and a core position of the rotation shaft 40 at the center portion of the rotation shaft 40 (denoted by 40B) is denoted by Cb. In this case, the core position Cb is displaced along the circumference of a circle with a radius d centered about the core position Ca at the rotating time when viewed in the core direction of the rotation shaft 40. Reference numeral 40' in FIG. 6B denotes a displaced rotation shaft 40B. In addition, if the rotation shaft 40 deviates, wherein the component of the Y direction at the displacement time is the component of the paper feeding direction, the precision of the paper feeding deteriorates.

For example, a transport device disclosed in JP-A-2006-82439 is configured so that as a rotation shaft, a transport driving roller is supported from the downstream side by an intermediate receiver in order to avoid the above-mentioned problems. However, the transport driving roller is pushed by the intermediate receiver as a result of the intermediate receiver receiving the pressing force of a transport driven roller so as to maintain the core position. Accordingly, a force by which a driven roller comes in contact with the driving roller has to be reduced. For example, as shown in FIGS. 6A and 6B, the discharge driven roller 42 is a roller in which cogs are attached to the circumference, and thus the force by which the discharge driven roller 42 comes in contact with the discharge driving roller 41 has to be reduced. With such a configuration, it is easy for the rotation shaft of the driving roller to move upward, thereby causing displacement in the component of the paper feeding direction, as described above.

Additionally, in JP-A-2001-341911 and particularly in FIG. 4, a supporting member ("intermediate supporting member 45") restricting the entire circumference of the rotation shaft ("shaft body 40") is shown. However, even with such a configuration, a displacement in the component of the paper feeding direction as in the foregoing description may occur due to a clearance between the rotation shaft and the supporting member. Moreover, restriction on the entire circumference of the rotation may induce shaft rotation load to increase in some cases.

In the configuration in which the rotation shaft is supported in the intermediate portion as in the known technique, it is difficult for displacement in the component of the paper feeding direction to occur while the rotation shaft continues to rotate in a certain direction (for example, forward rotation direction). However, since the rotation shaft of the roller repeatedly performs normal rotating motion and stopping of the motion in a printing operation, a displacement in the component of the paper feeding direction may occur at the time the printing operation stops. In particular, in a configuration in which paper is fed by a pair of rollers separated from each other in the paper feeding direction, a paper feeding speed can be configured to be higher in order to prevent the paper between the pair of rollers from becoming loose. At this time, since the roller on the downstream side receives a tensile force, reverse rotation may occur in the roller on the downstream side at the time the paper feeding stops. As a result, the displacement in the component of the paper feeding direction may occur as in the foregoing description.

The known printing apparatus is not configured so that the displacement in the component of the paper feeding direction caused by the rotation of the rotation shaft of the driving roller can be reliably prevented.

SUMMARY

An advantage of some aspects of the invention is that it prevents displacement in a component of a paper feeding direction caused by the rotation of a rotation shaft of a driving roller in order to prevent paper feeding precision from deteriorating.

According to an aspect of the invention, there is provided a printing medium feeding device including: a driving roller having a roller circumferential surface coming in contact with a printing medium to apply a feeding force to the printing medium around a core line of a rotation shaft and rotating to feeding the printing medium downstream; a driven roller in contact with the driving roller and following the rotation thereof; a shaft supporting member supporting the rotation shaft at least at two supporting positions; and a regulation unit regulating a core position of the rotation shaft between the two supporting positions at which the rotation shaft is supported by the shaft supporting member, wherein the regulation unit has a pressing surface coming in contact with the rotation shaft from the upstream side or the downstream side of the rotation shaft, and wherein the core position of the rotation shaft at the position of the regulation unit is located by the pressing surface downstream than a straight line passing through the core positions of the rotation shaft at the two supporting positions when the pressing surface comes in contact with the rotation shaft from the upstream side, and the core position of the rotation shaft at the position of the regulation unit is located to be more upstream than the straight line when the pressing surface comes in contact with the rotation shaft from the downstream side.

With such a configuration, the regulation unit regulating the core position of the rotation shaft has the pressing surface coming in contact with the rotation shaft from the upstream side or the downstream side of the rotation shaft, and the core position of the rotation shaft at the position of the regulation unit is located by the pressing surface downstream than the straight line passing through the core positions of the rotation shaft at the two supporting positions when the pressing surface comes in contact with the rotation shaft from the upstream side, and the core position of the rotation shaft at the position of the regulation unit is located to be more upstream than the straight line when the pressing surface comes in contact with the rotation shaft from the downstream side. Therefore, even when the rotation shaft has deviation in component precision, a displaceable range in the feeding direction of the printing medium at the time of rotation is narrowed or vanishes. Accordingly, it is possible to reliably reduce displacement in a component of the printing medium feeding direction caused by the rotation of the rotation shaft or prevent the occurrence of the displacement. Moreover, since the pressing surface comes in contact with the rotation shaft from one side, an increase in rotation load of the rotation shaft can be suppressed.

In the printing medium feeding device with the above-described configuration, the pressing surface may come in contact with the rotation shaft from the upstream side of the rotation shaft, and the core position of the rotation shaft at the position of the regulation unit may be located more downstream than the straight line passing through the core positions of the rotation shaft at the two supporting positions.

With such a configuration, the pressing surface comes in contact with the rotation shaft from the upstream side of the rotation shaft, and the core position of the rotation shaft at the position of the regulation unit is located more downstream than the straight line passing through the core positions of the rotation shaft at the two supporting positions. As a result, even when the driving roller receives a reaction force from the printing medium and the rotation shaft is pulled upstream, it is possible to prevent the rotation shaft from being bent by the pressing surface.

In the printing medium feeding device with the above-described configuration, when a distance between the core position of the rotation shaft at the position of the regulation unit regulation of the regulation unit and the straight line passing through the core positions of the rotation shaft at the two supporting positions is denoted by d, the regulation unit may locate the core position of the rotation shaft at the position of the regulation unit so as to be spaced apart by the distance d or more in a feeding direction of the printing medium from the straight line passing through the core positions of the rotation shaft at the two supporting positions.

With such a configuration, even when the rotation shaft has the deviation in component precision, the displaceable range in the feeding direction of the printing medium at the rotation time completely vanish. Accordingly, it is possible to more reliably prevent the displacement in the component of the printing medium feeding direction caused by the rotation of the rotation shaft.

In the printing medium feeding device with the above-described configuration, the rotation shaft may be formed by cutting the circumferential surface thereof by use of a lathe machining operation. In addition, in the lathe machining operation, the rotation shaft may be supported at least at two positions and is regulated so as not to be bent between the two supporting positions due to contact of a cutting blade, and the regulation unit may regulate the core position of the rotation shaft at the same position as the position at which the rotation shaft is regulated so as not to be bent due to the contact of the cutting blade in a shaft line direction of the rotation shaft.

With such a configuration, the rotation shaft is regulated so as not to be bent due to contact of the cutting blade between the two supporting positions, but the regulation position at this time and the position regulated by the regulation unit are the same, that is, the supporting state at the manufacturing time of the rotation shaft and the supporting state at the using time are the same. Accordingly, the deviation caused by the rotation of the rotation shaft does not increase. In addition, it is possible to prevent more reliably the displacement in the component of the printing medium feeding direction caused by the rotation of the rotation shaft from occurring.

In the printing medium feeding device with the above-described configuration, the regulation unit may include an intermediate support member having the pressing surface and being disposed so as to be displaceable in the feeding direction of the printing medium, and an urging member urging the intermediate support member in a direction in which the pressing surface comes in contact with the rotation shaft.

When the pressing surface is configured so as to be fixed, for example, when a member having the pressing surface is fixed by the screw, it is easy for the position of the pressing surface to be deviated and the shaft core of the rotation shaft may not be positioned at an appropriate position. In addition, when the pressing surface abrades due to the friction between the pressing surface and the rotation shaft, the shaft core of the rotation shaft may be deviated from the appropriate position.

However, with the above-described configuration, the pressing surface pressing the rotation shaft is displaceable and the rotation shaft is elastically pressed by the urging force of the urging member. Accordingly, it is possible to prevent the shaft core of the rotation shaft from being positioned at a deviated position and it is easy to perform an assembly work. In addition, even when the pressing surface abrades due to the friction between the pressing surface and the rotation shaft, the shaft core of the rotation shaft is positioned at the appropriate position. As a result, it is possible to reduce or prevent displacement in the component of the paper feeding direction caused by rotation of the rotation shaft more reliably for a long time.

In the printing medium feeding device with the above-described configuration, the driving roller may be a discharge driving roller that is rotatably disposed on the downstream side of a printing unit performing a printing operation on the printing medium. With such a configuration, advantages obtained from the above-described configuration can be apparent in the discharge driving roller. In addition, since the displacement in the component of the printing medium feeding direction caused by the rotation of the rotation shaft can be prevented without strongly bringing the discharge driven roller in elastic contact with the discharge driving roller, it is appropriate to use a roller with cogs on the circumference as the discharge driven roller.

According to another aspect of the invention, there is provided a printing apparatus including: a printing unit performing a printing operation on a printing medium; and the printing medium feeding device with the above-described configurations. With such a configuration, advantages obtained from the above-described configuration are apparent in the printing apparatus.

According to still another aspect of the invention, there is a liquid ejecting apparatus including: a liquid ejecting unit ejecting a liquid onto an ejection medium; a discharge driving roller having a roller circumferential surface coming in contact with a printing medium to apply a feeding force to the printing medium around a core line of a rotation shaft, rotating to feed the printing medium downstream, and being disposed on the downstream side of the liquid ejecting unit; a discharge driven roller coming in contact with the driving roller and following the rotation thereof; a shaft supporting member supporting the rotation shaft at least at two supporting positions; and a regulation unit regulating a core position of the rotation shaft between the two supporting positions at which the rotation shaft is supported by the shaft supporting member, wherein the regulation unit has a pressing surface coming in contact with the rotation shaft from the upstream side or the downstream side of the rotation shaft, and wherein the core position of the rotation shaft at the position of the regulation unit is located by the pressing surface to be more downstream than a straight line passing through the core positions of the rotation shaft at the two supporting positions when the pressing surface comes in contact with the rotation shaft from the upstream side, and the core position of the rotation shaft at the position of the regulation unit is located to be more upstream than the straight line when the pressing surface comes in contact with the rotation shaft from the downstream side.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
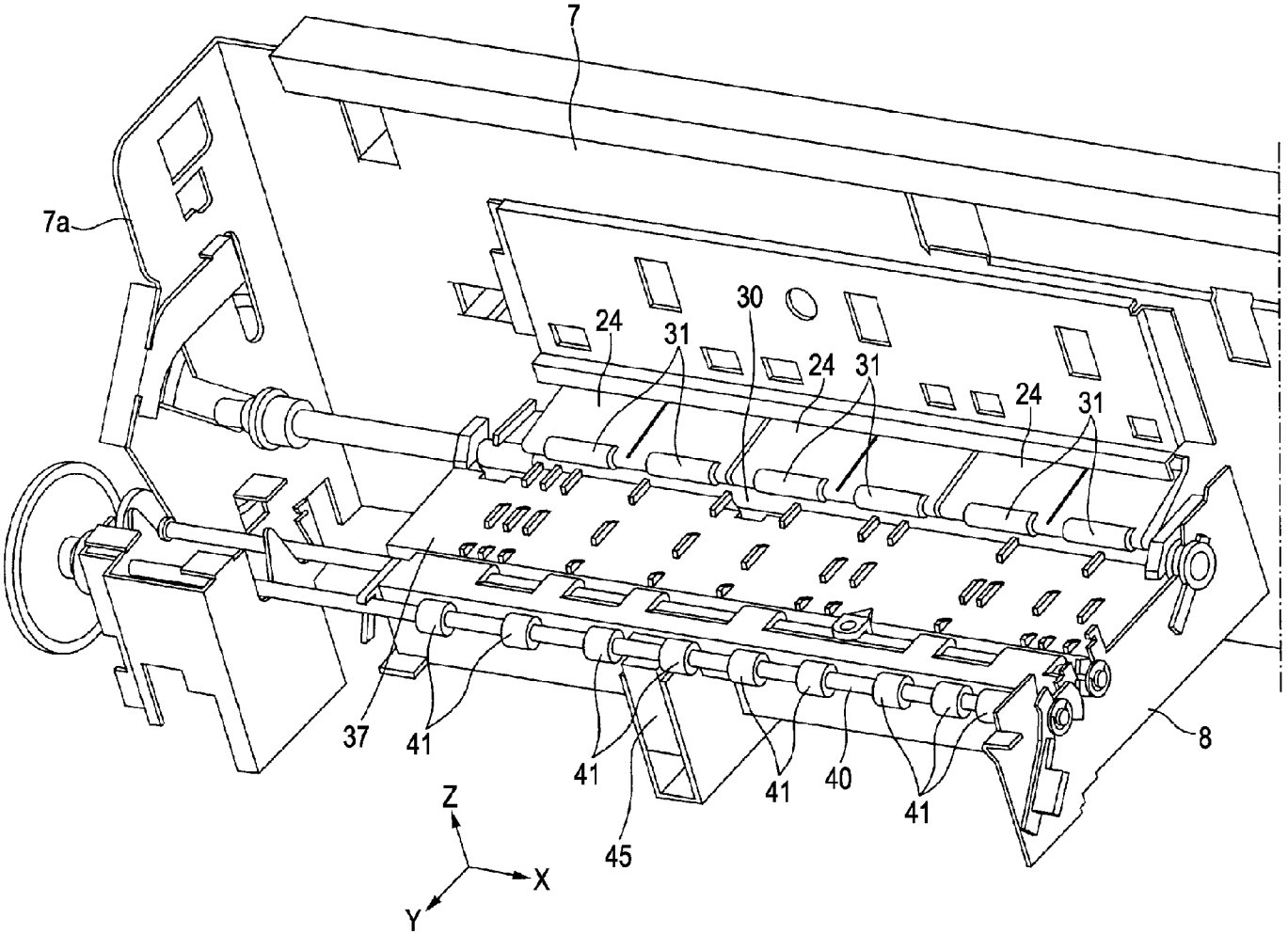
FIG. 1 is a perspective view illustrating an apparatus body of a printer according to an embodiment.
Figure 2:
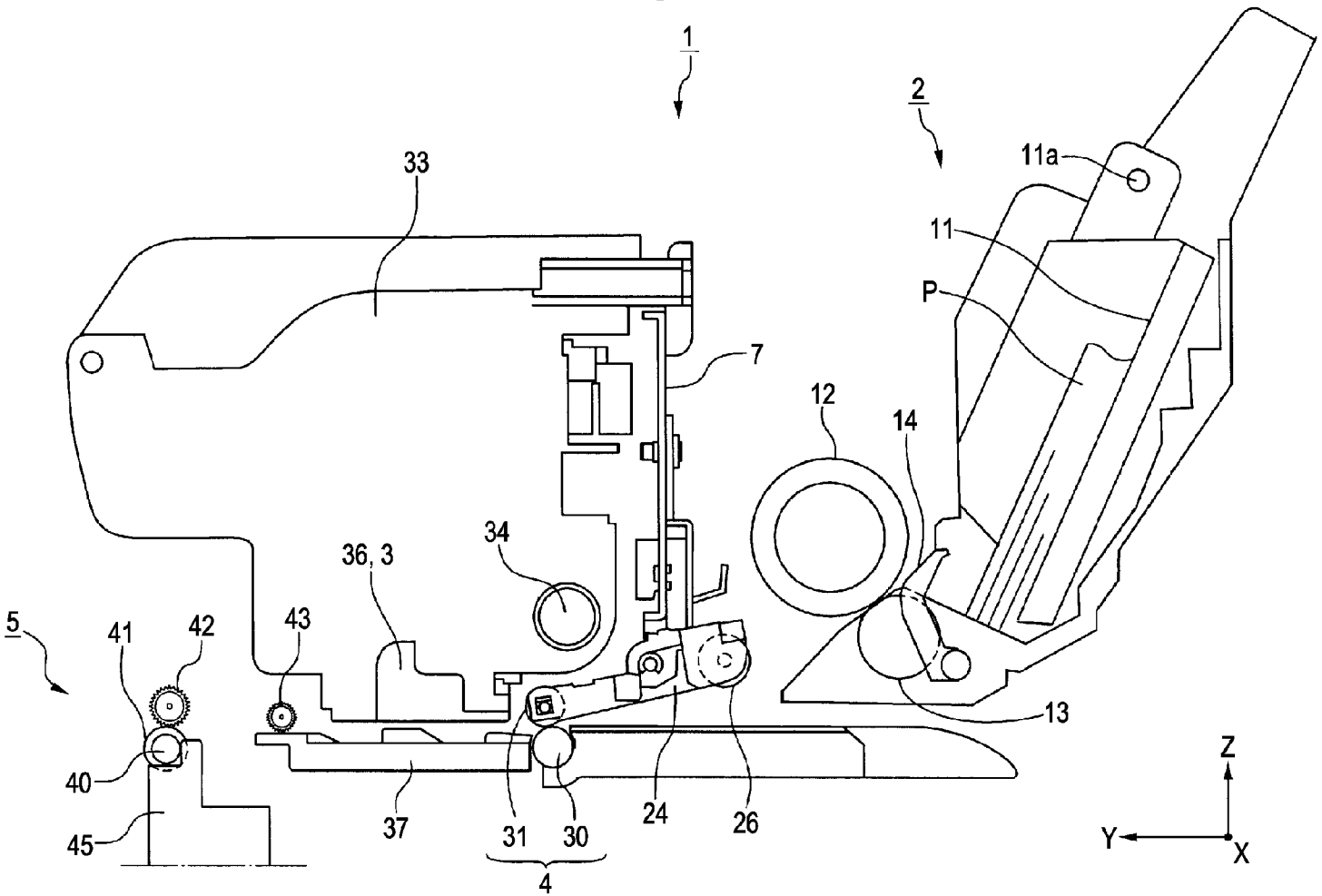
FIG. 2 is a side sectional view illustrating the apparatus body of the printer according to the embodiment.
Figure 3:
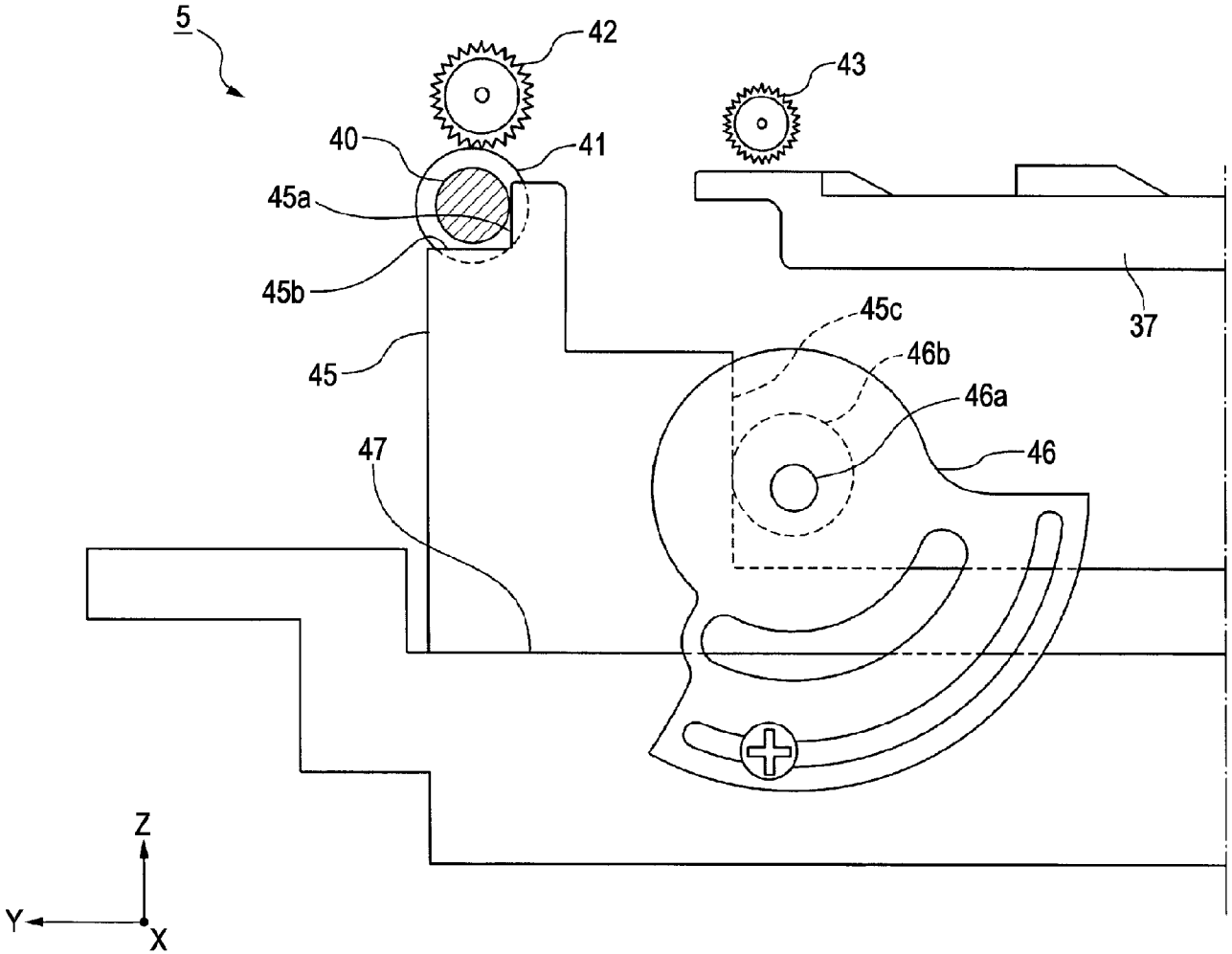
FIG. 3 is a side view illustrating a printing medium feeding device according to the embodiment.
Figure 4:
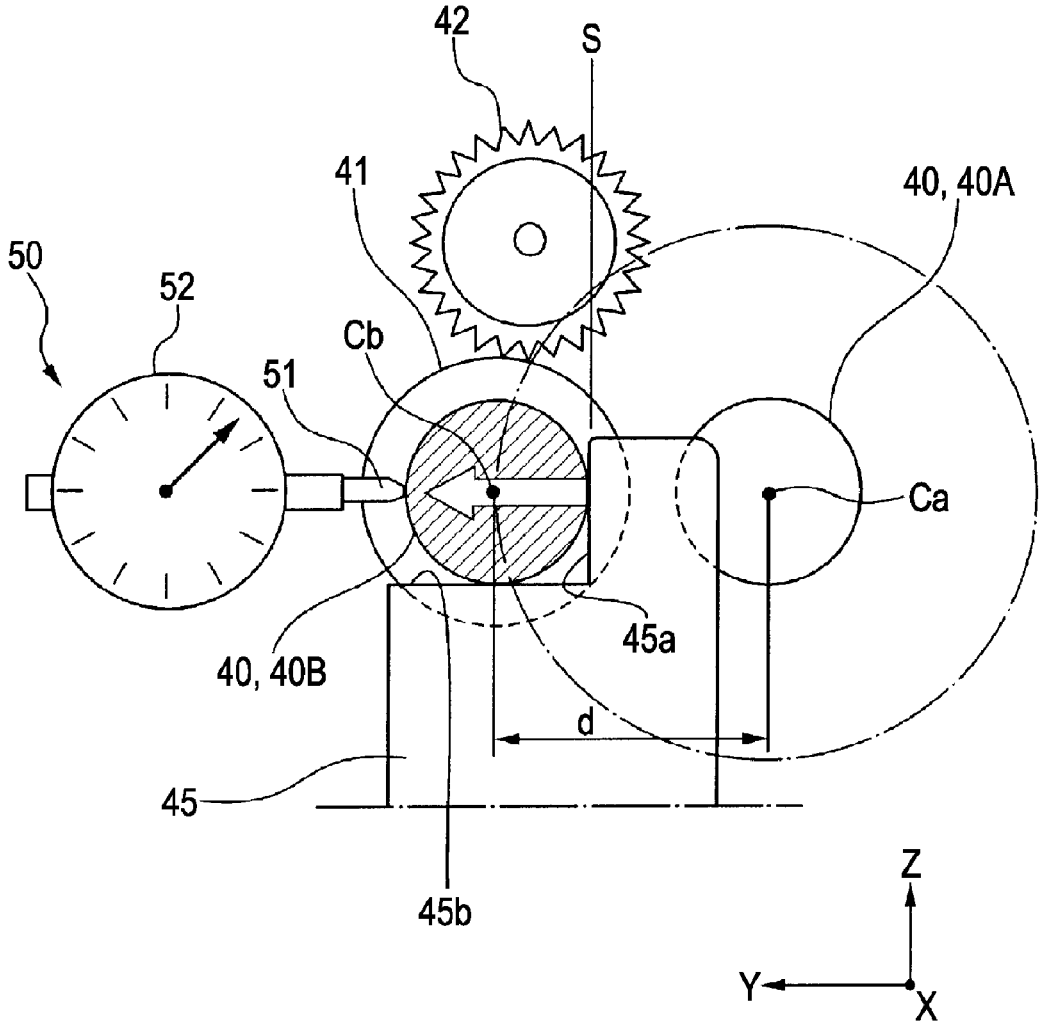
FIG. 4 is a diagram for explaining a method of adjusting a position of an intermediate support member (pressing surface) in a Y direction.
Figure 5:
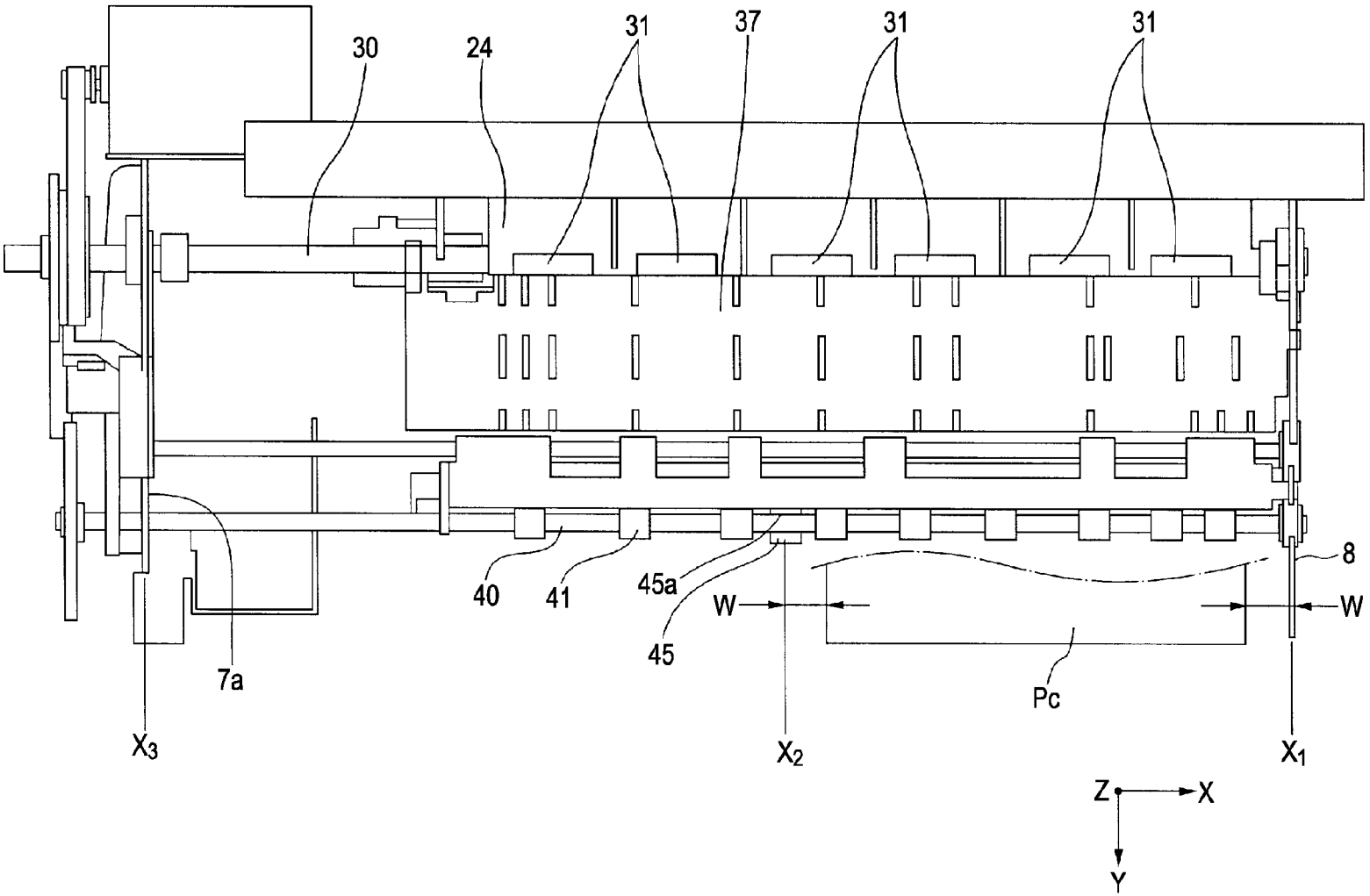
FIG. 5 is a top view illustrating the apparatus body of the printer according to the embodiment of the invention.

Hereinafter, an embodiment of the invention will be described with reference to FIGS. 1 to 5. FIG. 1 is a perspective view illustrating an apparatus body (in a state where an outer case thereof is separated) of "a printing apparatus" or an ink jet printer 1 (hereinafter, referred to as "a printer") as an example of "a liquid ejecting device" according to an embodiment. FIG. 2 is a side sectional view illustrating the apparatus body. FIG. 3 is a side view illustrating a discharge unit 5 as "a printing medium feeding device" according to the embodiment. FIG. 4 is a diagram for explaining a method of adjusting a position of an intermediate support member 45 (pressing surface 45*a*) in a Y direction. FIG. 5 is a top view illustrating the apparatus body of the printer 1 according to the embodiment of the invention.

First, an overview of the printer 1 will be described below with reference to FIGS. 1 and 2. Hereinafter, a left direction (front side of the printer) and a right direction shown in FIG. 2 refer to "a downstream side" and "an upstream side" of a paper feeding passage.

The printer 1 includes a feeding device 2 that can hold print paper (mainly, single paper sheet: hereinafter, referred to as "paper sheet P") so as to be inclined as an example of "a printing medium" or "an ejection medium" in the rear thereof. In addition, the printer 1 feeds the paper sheet P from the feeding device 2 to a transport unit 4 on the downstream side. The fed paper sheet P is transported by the transport unit 4 or the discharge unit 5 downstream so that a printing head 36 (printing unit 3) performs a printing operation. Alternatively, the transport unit 4 cooperates with the discharge unit 5 to transport the fed paper sheet P. The paper sheet P onto which the printing head 36 performs the printing operation is discharged to the front side of the printer by the discharge unit 5 downstream.

Hereinafter, the printing process will be described in detail. The feeding device 2 includes a hopper 11, a feeding roller 12, a retard roller 13, and a return lever 14. The hopper 11 having a plate shape is movable about an upper movable point 11*a* so that the paper sheet P supported on the hopper 11 so as to be inclined comes in pressing contact with the feeding roller 12 and so that the paper sheet P is also separated from the feeding roller 12.

The retard roller 13 is disposed so as to perform forward rotating motion or backward rotating motion about the feeding roller 12 and predetermined rotation resistance (torque) is applied to the retard roller 13. When the retard roller 13 comes in contact with the feeding roller 12 and one paper sheet P is fed without feeding an overlapped paper sheet P, the retard roller 13 follows the rotation of the feeding roller 12. Alternatively, when a plurality of the paper sheet P exist between the feeding roller 12 and the retard roller 13, the retard roller 13 does not rotate and stops to prevent the overlapped paper sheet P from being fed. The return lever 14 is movable when viewed from a side of a feeding passage of the paper sheet P and moves to return the overlapped paper sheet P to be fed to the hopper 11.

Between the feeding device 2 and the transport unit 4, there is provided a detection unit (not shown) that detects the paper sheet P in the course of being fed. Moreover, there is provided a guide roller 26 that appropriately guides the paper sheet P and prevents the paper sheet P from coming in contact with the feeding roller 12 in order to reduce transport load.

The transport unit 4 includes a transport driving roller 30 driven so as to be rotated by a motor (not show) and transport driven rollers 31 coming in pressing contact with the transport driving roller 30 and following the rotation thereof. The transport driving roller 30 includes a roller circumferential surface (for example, an outer circumferential surface has sufficient friction with the paper sheet P and has abrasion resistance particles) that comes in contact with the paper sheet P around a core line of a rotation shaft (for example, a metallic shaft) extending in a width direction of the paper sheet P (main scanning direction: an X direction). A plurality of the transport driven rollers 31 (6 transport driven rollers in this embodiment) are arranged in a shaft line direction of the transport driving roller 30.

As shown in FIG. 1, two transport driven rollers 31 are supported so as to be rotated in the downstream ends of an upper paper guide 24 by a shaft. In addition, three upper paper guides 24 are arranged in parallel in a direction of a paper width according to this embodiment. The upper paper guides 24 are supported so as to be movable about a main frame 7 by a shaft and also urged in a direction in which the transport driven rollers 31 come in pressing contact with the transport driving roller 30 by a coil spring. The paper sheet P arriving in the transport unit 4 is nipped between the transport driving roller 30 and the transport driven rollers 31 and is transported in a sub-scanning direction downstream by rotation of the transport driving roller 30.

On the downstream side of the transport unit 4, the ink jet printing head (hereinafter, referred to as "a printing head") and a front paper guide 37 opposed to the printing head 36 are disposed. The printing head 36 is disposed on the bottom surface of a carrier 33. The carrier 33 is driven so as to be reciprocated in the main scanning line by a driving motor (not shown) while being guided to a carrier guide shaft 34 extending in the main scanning line. In the front paper guide 37 regulating a distance between the paper sheet P and the printing head 36, a plurality of ribs are formed on a surface opposite the printing head 36. In addition, the paper sheet P is supported from below by the ribs.

Next, on the downstream side, there are provided a supplementary roller 43 and the discharge unit 5. The supplementary roller 43 is disposed so as to come in contact with the printed paper sheet P and be driven on a paper feeding passage reaching the discharge unit 5 from an area where the printing head 36 is opposite the front paper guide 37. The supplementary roller 43 is disposed in this manner to prevent the paper sheet P from rising from the front paper guide 37 and to maintain a uniform distance between the paper sheet P and the printing head.

The discharge unit 5 includes a discharge driving roller 41 that has a roller circumferential surface coming in contact with the circumference of a core line of a rotation shaft 40 rotated by a motor (not shown) to apply a feeding force to the paper sheet P. The discharge unit 5 also includes a discharge driven roller 42 coming in elastic contact with the discharge driving roller 41. A plurality of the discharge driving rollers 41, which are made of rubber in this embodiment, are disposed in a shaft line direction of the rotation shaft 40 extending in the direction of the paper width at an appropriate interval. The discharge driven roller 42 is a roller where a plurality of cogs are attached to the outer circumference thereof (where the same is applied to the supplementary roller 43). Moreover, a plurality of the discharge driven rollers 42 are disposed to come in contact with the discharge driving rollers 41.

When the paper sheet P subjected to the printing operation of the printing head 36 is nipped between the discharge driving rollers 41 and the discharge flowing rollers 42, the paper sheet P is discharged to the front side (stacker which is not shown) of the printer.

The printer 1 can perform a so-called printing with no margins in which the upper and lower portions of the paper sheet P are printed without margins. When the printing in which the upper portion of the paper sheet P is printed without a margin is performed, the upper portion of the paper sheet P does not reach the discharge driving roller 41. Accordingly, the paper sheet P receives the feeding force only from the transport driving roller 30. Subsequently, when the upper portion of the paper sheet P reaches the discharge driving roller 41, the paper sheet P receives the feeding force from both the transport driving roller 30 and the discharge driving roller 41.

When the lower portion of the paper sheet P is no longer in contact with the transport driving roller 30, the paper sheet P receives a feeding force only from the discharge driving roller 41. In this way, when the printing with no margin is performed, the roller determining the feeding precision for the paper sheet P is switched in accordance with a position in the feeding direction of the paper sheet P. Accordingly, the feeding precision of the discharge driving roller 41 directly affects print quality.

The overall configuration of the printer 1 has been described above. Hereinafter, as a printing medium feeding device, the discharge unit 5 will be described in detail.

As shown in FIG. 1, the rotation shaft 40 of the discharge driving roller 41 is supported by a left-side frame 7*a* and an intermediate frame 8 constituting "a shaft supporting member (bearing)" that supports both ends of the rotation shaft 40. In addition, the rotation shaft 40 is also supported by an intermediate support member 45 constituting "a regulation unit" between the left-side frame 7*a* and the intermediate frame 8. That is, the rotation shaft 40 is supported by the left-side frame 7*a* and the intermediate support member 45, and the core position of the rotation shaft 40 is regulated between two supporting positions by the intermediate support member 45.

As shown in FIG. 3, the intermediate support member 45 includes the pressing surface 45*a* and a supporting surface 45*b*. In addition, a core position of the rotation shaft 40 in the Y direction (a feeding direction of the paper sheet P) is regulated by the pressing surface 45*a* contacting with the rotation shaft 40 from the upstream side and the rotation shaft 40 is supported by the supporting surface 45*b* so that the core position is regulated.

The intermediate support member 45 can be slid along a base 47 in the Y direction and is urged upstream (right direction in FIG. 3) by an urging member (not shown). The intermediate support member 45 has a contact surface 45*c* perpendicular to the Y direction and the contact surface 45*c* comes in contact with a cam portion 46*b* of a cam member 46 so that the position of the intermediate support member 45 (the pressing surface 45*a*) in the Y direction is determined.

The cam member 46 is disposed so as to rotate about a shaft 46*a* and the cam portion 46*b* is configured to rotate about the shaft 46*a* as an eccentric shaft. Accordingly, the contact surface 45*c* (the intermediate support member 45) is slid in the Y direction by allowing the cam member 46 to be rotated, so that the pressing surface 45*a*, that is, the position of the rotation shaft 40 in the Y direction can be adjusted minutely.

Figure 6A:
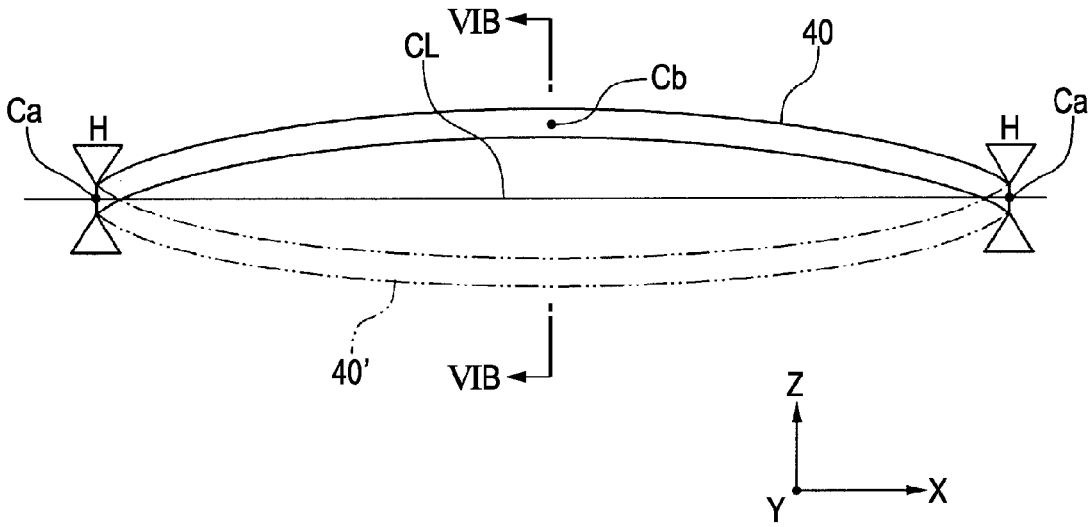
FIG. 6A is diagram illustrating a deviation of a rotation shaft and FIG. 6B is a diagram taken along the line A-A shown in FIG. 6A.
Figure 6B:
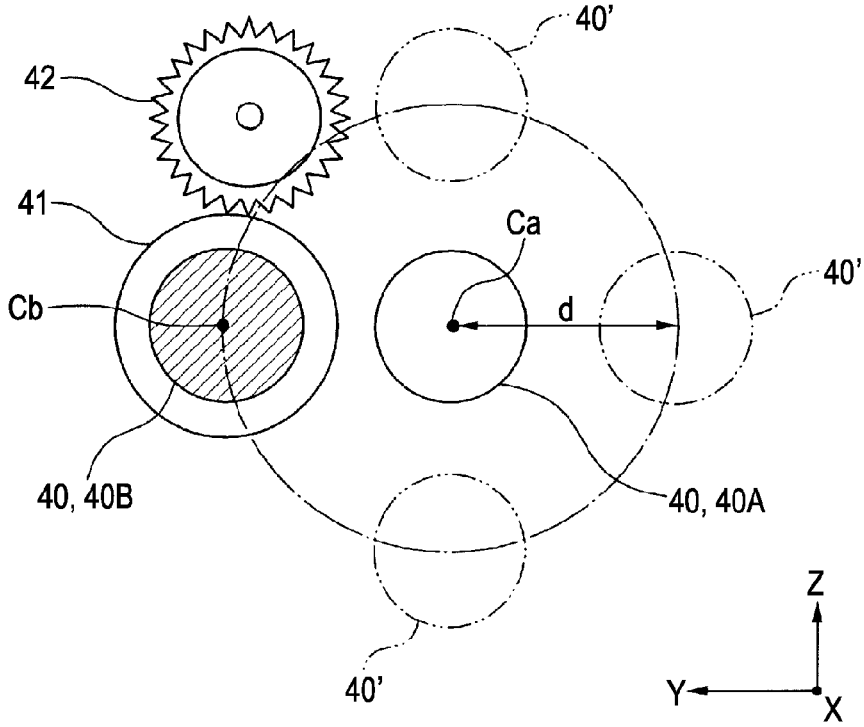

FIG. 4 is a diagram for explaining a method of adjusting the position of an intermediate support member 45 (the pressing surface 45*a*) in the Y direction. Ca denotes a core position corresponding to two supporting positions (the positions of the left-side frame 7*a* and the intermediate frame 8 according to this embodiment) of the rotation shaft 40, as in FIG. 6. Cb denotes a core position where the rotation shaft 40 is pressed by the pressing surface 45*a* of the intermediate support member 45.

As shown in FIG. 4, the pressing surface 45*a* comes in contact with the rotation shaft 40 from the upstream side and the core position Cb is positioned on the downstream side by a distance d from the core position Ca (more specifically, a straight line (which is denoted by CL in FIG. 6A) passing through the core position Ca at both ends). Accordingly, even if the rotation shaft 40 has a deviation of component accuracy, the rotation shaft 40 is not displaced more upstream than a position (position of the pressing surface 45*a*) denoted by a line S at a position pressed by the pressing surface 45*a*. That is, a displaceable range of the rotation shaft 40 at the time of rotation is narrowed or vanishes. In this way, it is possible to prevent paper feeding precision from deteriorating due to the deviation of the rotation shaft 40.

It is desirable that the core position Cb is determined at a position where the displacement caused by the deviation of the rotation shaft 40 in the Y direction is eliminated. More specifically, it is desirable that the core position Cb be located at a distance from the core position Ca larger than the distance d shown in FIG. 6B. That is, without the regulation of the pressing surface 45*a*, it is desirable that the core position Cb is determined on the downstream side of the core position Ca at a distance from the core position Ca (that is, ½ of deviation of the accuracy of the rotation shaft 40) equal to or more than that between the core position Cb in the position of the pressing surfaces 45*a* and the core position Ca.

In this way, the rotation shaft 40 normally comes in contact with the pressing surface 45*a* at the time of rotation, so that the core position Cb be negligibly displaced in the Y direction at the time of rotation. However, even if the distance is equal or less than the distance d, it is possible to suppress the displacement in the Y direction caused by the rotation of the rotation shaft 40.

In this embodiment, the pressing surface 45*a* comes in contact with the rotation shaft 40 from the upstream side thereof. However, even though the pressing surface 45*a* comes in contact with the rotation shaft 40 from the downstream side thereof, the deviation in the Y direction caused by the rotation of the rotation shaft 40 can be reduced. However, when a paper feeding speed by the drive of the discharge driving roller 41 is set to be larger than that by the drive of the transport driving roller 30 in order to prevent the paper between the transport driving roller 30 and the discharge driving roller from becoming loose, the center portion of the rotation shaft 40 of the discharge driving roller 41 is likely to be pulled upstream and bent. Accordingly, as in this embodiment, when the pressing surface 45*a* is configured to come in contact with the rotation shaft 40 from the upstream side, the rotation shaft 40 can be prevented from being bent.

The core position Cb can be positioned by use of, for example, a dial gauge 50. Specifically, as shown in FIG. 4, a measurement ruler 51 of a dial gauge 50 is disposed on the downstream side (side opposite the portion pressed by the pressing surface 45*a*) of the rotation shaft 40. Then, the intermediate support member 45 (the pressing surface 45*a*) is gradually made to slide from the upstream side to the downstream side (a direction of an arrow A) until a detection unit 52 detects no variation, while allowing the rotation shaft 40 to rotate forward and backward. In this way, the core position Cb can be easily positioned at a position (where displacement in the Y direction caused by the rotation) which is at the distance d from the core position Ca.

The rotation shaft 40 is formed by cutting the circumferential surface using a lathe machining operation. However, it is possible to prevent the deviation at the time of rotation from increasing by allowing the support state in the lathe machining operation and the support state at the time the mounting operation in the printer 1 is performed to be the same. That is, in a case where the rotation shaft 40 is supported at least at two positions by bearings in the lathe machining operation and the regulation unit regulates between the two positions so as to prevent the rotation shaft 40 from being bent due to the cutting blade at the manufacturing time, the position of the pressing surface 45*a* in a shaft line direction of the rotation shaft 40 at the time the rotation shaft 40 is mounted in the printer 1 is made to be the same as the position where the regulation unit regulates the rotation shaft 40 so as not to be during manufacture.

In this way, the core position of the rotation shaft 40 is regulated at the same position as the intermediate support position in the lathe machining operation and the support state at the time the rotation shaft 40 is manufactured and the support state at the time the rotation shaft 40 is used. Accordingly, it is possible to further prevent the paper feeding precision from deteriorating without increasing the deviation caused by the rotation of the rotation shaft 40. The term "made to be the same as" does not only refer to the exact same position, but also means that the position where the regulation unit regulates the rotation shaft 40 so as not to be bent during manufacture may be deviated from the position of the pressing surface 45*a* to some extent in that the same effect can be achieved.

It is desirable that the intermediate support position of the rotation shaft 40 is configured at a position shown in FIG. 5 in consideration of the paper sheet P on which the printing with no margins is frequently performed. That is, Pc shown in FIG. 5 refers to, for example, an L size photographic paper sheet. X1, X2, and X3 refer to a position of an intermediate frame 8 in the X direction, a position of the pressing surface 45*a* in the X direction, and a left-side frame 7*a* in the X direction. However, as shown in FIG. 5, the pressing surface 45*a* and the intermediate frame 8 are positioned so as to be separated by a substantially equal distance W from respective side ends of the paper sheet Pc. With such a configuration, the rotation shaft 40 is bent so as to be symmetrical about the center of the paper sheet Pc in the X direction, and thus it is possible to prevent the paper sheet Pc from passing obliquely.

In the above-described configuration, the example in which the printing medium feeding device is applied to the discharge unit 5 on the downstream side of the printing head 36 has been described. However, the invention is not limited thereto. For example, the printing medium feeding device may be applied to the transport unit 4 on the upstream side of the printing head 36. In addition, the rotation shaft 40 is configured to be pressed at one position between two supporting positions, but may be configured to be pressed at two or more positions.

In this embodiment, the pressing surface 45*a* comes in contact with the outer circumferential surface of the rotation shaft 40. However, the pressing surface 45*a* may directly come in contact with the outer circumferential surface (circumferential surface of the roller) of the discharge driving roller 41 so as to regulate the core position Cb. In this case, since the circumferential surface of the discharge driving roller 41 has a high-friction coefficient, the pressing surface 45*a* may be configured to come in contact with the outer circumferential surface of the discharge driving roller 41 instead of the roller which can freely rotate.

Figure 7:
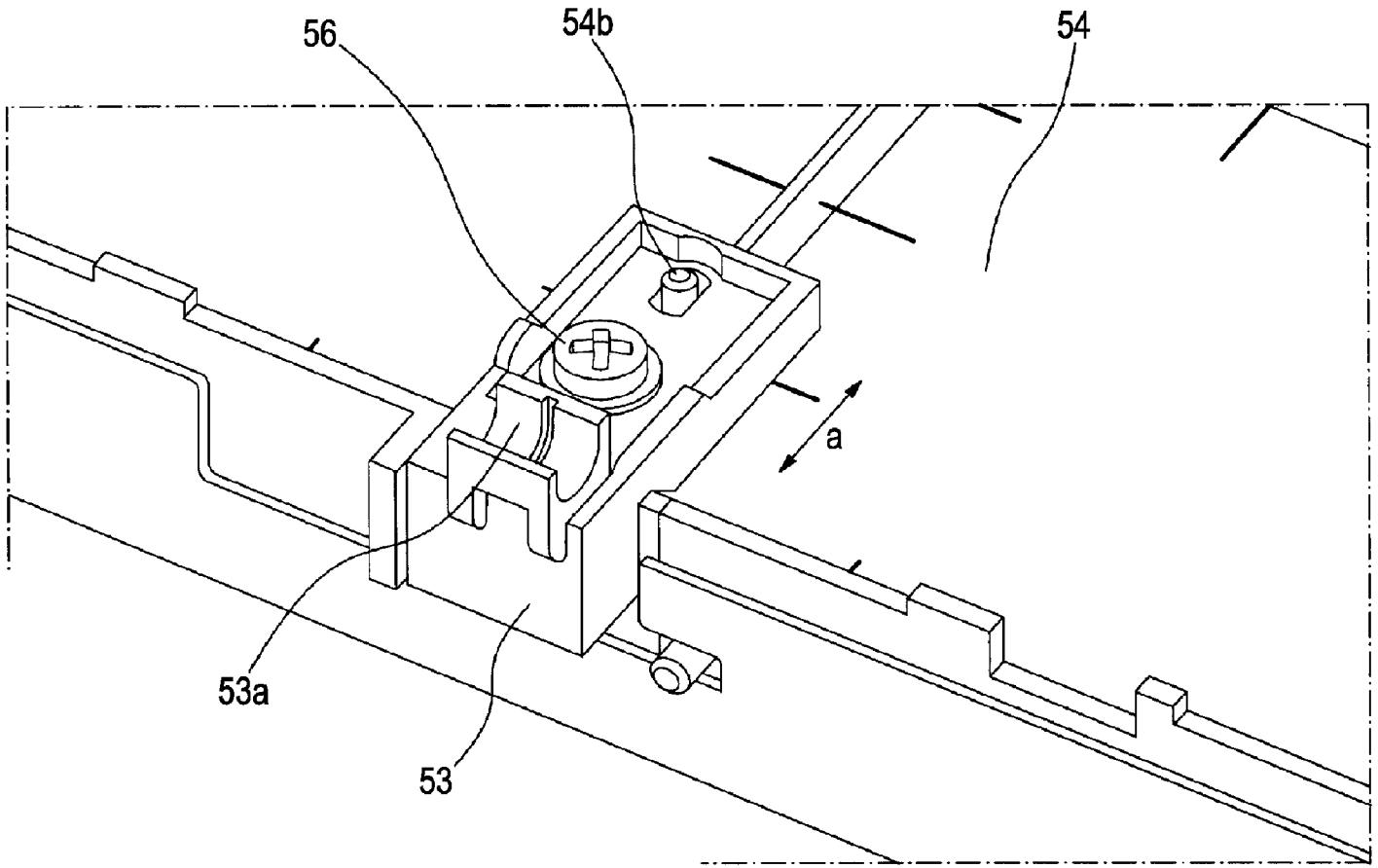
FIG. 7 is a perspective view illustrating an intermediate support member according to another embodiment of the invention.
Figure 8:
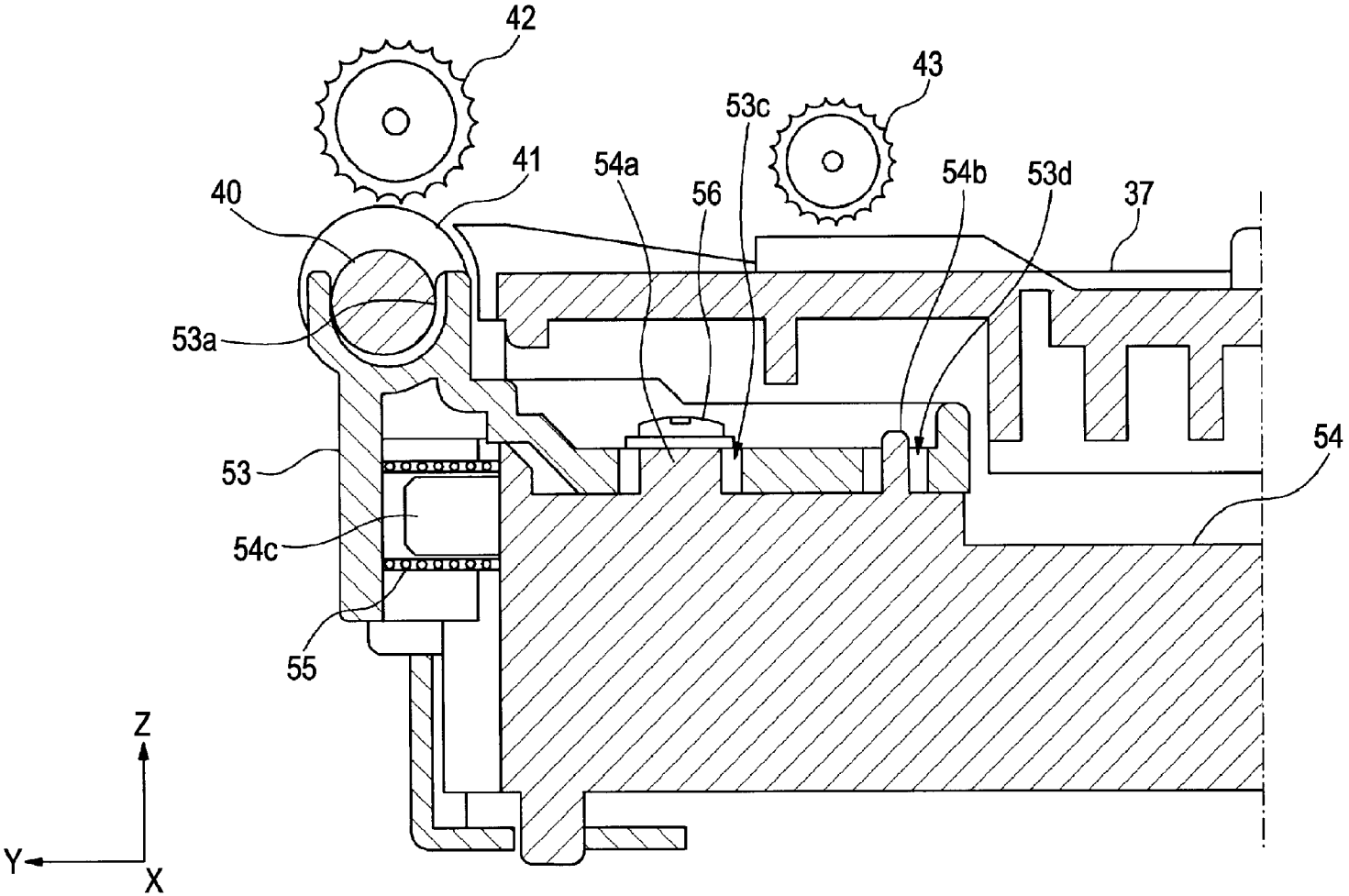
FIG. 8 is a side sectional view illustrating the intermediate support member according to another embodiment of the invention.

The intermediate support member 45 having the pressing surface 45*a* does not have to be fixedly disposed, but may be disposed so as to be slidable. In addition, the intermediate support member 45 may be configured so as to be urged by the urging member and the pressing surface 45*a* may be also configured so as to elastically come in contact with the rotation shaft 40. Hereinafter, an embodiment with such a configuration will be described with reference to FIGS. 7 and 8. FIG. 7 is a perspective view illustrating an intermediate support member according to another embodiment. FIG. 8 is a side sectional view illustrating the intermediate support member.

Reference numeral 53 in FIGS. 7 and 8 indicates an intermediate support member according to another embodiment of the intermediate support member 45. The intermediate support member 53 is formed so as to be slidable in a paper feeding direction (Y direction: an arrow a direction in FIG. 8) in a lower paper guide 54 disposed below the front paper guide 37 (FIG. 1).

More specifically, as shown in FIG. 8, bosses 54*a* and 54*b* are formed in the lower paper guide 54 and long holes 53*c* and 53*d* are formed in the paper feeding direction in the intermediate support member 53. The bosses 54*a* and 54*b* are loosely inserted into the long holes 53*c* and 53*d*. Reference numeral 56 indicates a screw and a screw 56 is inserted into a screw hole (not shown) formed in the boss 54*a* so that the intermediate support member 53 cannot move upward. The boss 54*a* regulates the intermediate support member 53 in a Z direction. In addition, the boss 54*b* regulates the intermediate support member 53 in the X direction and the slide of the intermediate support member 53 in the Y direction.

A spring holding portion 54*c* is formed on the front side (the left side in FIG. 8) of the intermediate support member 53. In addition, as "an urging member", a coil spring 55 is fitted into the spring holding portion 54*c* and the intermediate support member 53 is urged in a direction in which the pressing surface 53*a* comes in contact with the rotation shaft 40.

With such a configuration, it is not necessary to precisely adjust the fixation position of the intermediate support member 53. Accordingly, the core line (the core position Cb shown in FIG. 4) of the rotation shaft 40 can be easily positioned at an appropriate position. Even when the pressing surface 53*a* becomes abraded to some extent due to friction generated between the pressing surface 53*a* and the rotation shaft 40, the core line of the rotation shaft 40 is positioned at the appropriate position. Accordingly, it is possible to reduce or prevent displacement in the component of the paper feeding direction caused by rotation of the rotation shaft 40 more reliably for a long time. In this embodiment, as shown in FIG. 8, the coil spring 55 urges the intermediate support member 53 in the direction in which the pressing surface 53*a* comes in contact with the rotation shaft 40. Even when the pressing surface 53*a* becomes abraded to some extent due to the friction generated between the pressing surface 53*a* and the rotation shaft 40, an elastic force of the coil spring allows the core line of the rotation shaft 40 to be positioned at the appropriate position. Accordingly, even if the urging direction of the coil spring is directed to the paper feeding direction, it is possible to reduce the displacement in the component of the paper feeding direction caused by the rotation of the rotation shaft. That is, the elastic force of the coil spring and the fixation of the intermediate support member on the long hole in the paper feeding direction results in a large allowance range of the fixation position of the intermediate support member, compared with a structure in which the coil spring is not used.

What is claimed is:

1. A printing medium feeding device comprising:

a shaft supporting member supporting a rotation shaft at least at two supporting positions;

a regulation unit regulating a core position of the rotation shaft located between the two supporting positions where the rotation shaft is supported by the shaft supporting member, a driving roller having a roller circumferential surface which comes in contact with a printing medium, applies a force to the printing medium by rotating the rotation shaft, and feeds a printing medium from an upstream side to a downstream side of a straight line passing through the rotation shaft center at the supporting positions along a feeding direction;

a driven roller in contact with the driving roller which follows the rotation thereof; and wherein the regulation unit has an intermediate member including a pressing surface which comes into contact with the rotation shaft on either the upstream side or the downstream side of the rotation shaft so as to move the core position of the rotation shaft located between the two supporting positions toward the downstream side or upstream side of the line passing through the rotation shaft center at the supporting positions, the intermediate support member being urged by an urging member.

2. The printing medium feeding device according to claim 1, wherein the rotation shaft is formed by cutting the circumferential surface thereof by use of a lathe machining operation, wherein in the lathe machining operation, the rotation shaft is supported at least at two positions and is regulated so as not to be bent between the two supporting positions due to contact of a cutting blade, and wherein the regulation unit regulates the core position of the rotation shaft at the same position as the position at which the rotation shaft is regulated so as not to be bent due to the contact of the cutting blade in a shaft line direction of the rotation shaft.

3. The printing medium feeding device according claim 1, wherein the driving roller is a discharge driving roller that is rotatably disposed on the downstream side of a printing unit performing a printing operation on the printing medium.

4. A printing apparatus comprising:

a printing unit performing a printing operation on a printing medium; and the printing medium feeding device according to claim 1.

5. A liquid ejecting apparatus comprising:

a liquid ejecting unit ejecting a liquid onto an ejection medium;

a shaft supporting member supporting a rotation shaft at least at two supporting positions;

a regulation unit regulating a core position of the rotation shaft located between the two supporting positions where the rotation shaft is supported by the shaft supporting member;

a discharge roller having a roller circumferential surface which comes contact with a printing medium, applies a force to the printing medium by rotating the rotation shaft, feeds the printing medium from an upstream side to a downstream side of a straight line passing through the rotation shaft center at the supporting positions along a feeding direction, and being disposed on the downstream side of the liquid ejecting unit;

a discharge driven roller coming in contact with the driving roller which follows the rotation thereof; and wherein the regulation unit has an intermediate member including a pressing surface which comes into contact with the rotation shaft on either the upstream side or the downstream side of the rotation shaft so as to move the core position of the rotation shaft located between the two supporting positions toward the downstream side or upstream side of the line passing through the rotation shaft center at the supporting positions, the intermediate support member being urged by an urging member.

* * * * *